US011847965B2

(12) United States Patent
Xiang et al.

(10) Patent No.: US 11,847,965 B2
(45) Date of Patent: Dec. 19, 2023

(54) PIXEL STRUCTURE, DRIVING METHOD THEREOF AND DISPLAY DEVICE

(71) Applicants: Chengdu BOE Optoelectronics Technology Co., Ltd., Sichuan (CN); BOE TECHNOLOGY GROUP CO., LTD., Beijing (CN)

(72) Inventors: Lian Xiang, Beijing (CN); Wenbo Chen, Beijing (CN); Yudan Shui, Beijing (CN); Zhengmao Yu, Beijing (CN); Shanghong Li, Beijing (CN)

(73) Assignees: Chengdu BOE Optoelectronics Technology Co., Ltd., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 210 days.

(21) Appl. No.: 17/425,773

(22) PCT Filed: Sep. 28, 2020

(86) PCT No.: PCT/CN2020/118415

§ 371 (c)(1),
(2) Date: Jul. 26, 2021

(87) PCT Pub. No.: WO2022/061892

PCT Pub. Date: Mar. 31, 2022

(65) Prior Publication Data

US 2022/0319419 A1 Oct. 6, 2022

(51) Int. Cl.
*G09G 3/3233* (2016.01)

(52) U.S. Cl.
CPC ... *G09G 3/3233* (2013.01); *G09G 2300/0842* (2013.01); *G09G 2310/061* (2013.01)

(58) Field of Classification Search
CPC ..... G09G 3/3233; G09G 2300/0842; G09G 2310/061
See application file for complete search history.

(56) References Cited

U.S. PATENT DOCUMENTS

2017/0039934 A1* 2/2017 Ma ..... G09G 3/3233

FOREIGN PATENT DOCUMENTS

CN 107068057 A 8/2017
CN 107170408 A * 9/2017 ..... G09G 3/3233
CN 107170408 A 9/2017

(Continued)

*Primary Examiner* — Amare Mengistu
*Assistant Examiner* — Jennifer L Zubajlo
(74) *Attorney, Agent, or Firm* — HOUTTEMAN LAW LLC

(57) ABSTRACT

A pixel structure, a driving method thereof and a display device are disclosed. The pixel structure includes: a pixel circuit and a plurality of light emitting devices; the pixel circuit has a plurality of display periods, each display period includes: a first reset stage, a data write stage, a second reset stage and a light emitting stage, the driving method includes: in the second reset stage, providing a valid level signal to at least one second reset line to cause the corresponding second reset sub-circuit to write a voltage on the initialization signal line into a first electrode of the light emitting device; in the light emitting stage, providing a valid level signal to a first light emitting control line and providing a valid level signal to at least one second light emitting control line.

12 Claims, 9 Drawing Sheets

(56) References Cited

FOREIGN PATENT DOCUMENTS

| | | | |
|---|---|---|---|
| CN | 109817157 | A | 5/2019 |
| CN | 111063306 | A | 4/2020 |
| CN | 111312158 | A | 6/2020 |
| CN | 111477671 | A | 7/2020 |
| JP | 2012128172 | A | 7/2012 |

* cited by examiner

PIXEL STRUCTURE, DRIVING METHOD THEREOF AND DISPLAY DEVICE

TECHNICAL FIELD

The present disclosure relates to the field of display technology, and in particular to a pixel structure, a driving method thereof and a display device.

BACKGROUND

Active Matrix Organic Light Emitting Diode (AMOLED) has a wider and wider application. A pixel display device of the AMOLED is an Organic Light emitting Diode (OLED). In the AMOLED, a driving transistor generates a driving current in a saturation state to drive a light emitting device to emit light.

SUMMARY

The embodiment of the present disclosure provides a pixel structure, a driving method thereof and a display device.

In a first aspect, the embodiment of the present disclosure provides a driving method for a pixel structure, the pixel structure including: a pixel circuit and a plurality of light emitting devices; wherein the pixel circuit includes: a driving transistor, a storage capacitor, a write compensation sub-circuit, a first reset sub-circuit, a first light emitting control sub-circuit, a plurality of second light emitting control sub-circuits, and a plurality of second reset sub-circuits, wherein two terminals of the storage capacitor are respectively connected to a gate of the driving transistor and a first power line; the second light emitting control sub-circuits and the second reset sub-circuits are connected to the light emitting devices in a one-to-one correspondence; the plurality of second reset sub-circuits are respectively connected to a plurality of second reset lines; the plurality of second light emitting control sub-circuits are connected to a plurality of second light emitting control lines, respectively;

the pixel circuit has a plurality of display periods, each display period includes: a first reset stage, a data write stage, a second reset stage and a light emitting stage, the driving method includes steps of:

in the first reset stage, providing a valid level signal to a first reset line to cause the first reset sub-circuit to write a voltage signal on an initialization signal line into the gate of the driving transistor;

in the data write stage, providing a valid level signal to a scan line to cause the write compensation sub-circuit to write a voltage signal on a data line into the first electrode of the driving transistor and connect the gate and the second electrode of the driving transistor;

in the second reset stage, providing a valid level signal to at least one second reset line to cause the corresponding second reset sub-circuit to write a voltage on the initialization signal line to a first electrode of the light emitting device;

in the light emitting stage, providing a valid level signal to a first light emitting control line and providing a valid level signal to at least one second light emitting control line, so that the first light emitting control sub-circuit causes the first power line and the first electrode of the driving transistor to be directly electrically connected to each other, and the at least one second light emitting control sub-circuit causes the second electrode of the driving transistor and the corresponding light emitting device to be directly electrically connected to each other.

In some embodiments, at least two of the plurality of light emitting devices connected to a same pixel circuit have different colors;

the step of providing a valid level signal to the at least one second reset line includes: providing a valid level signal to each second reset line;

the step of providing a valid level signal to the at least one second light emitting control line includes: providing a valid level signal to the plurality of second light emitting control lines, respectively.

In some embodiments, the plurality of light emitting devices connected to a same pixel circuit have a same color;

a valid level signal is provided to the n second light emitting control lines by turns in the light emitting stages in n consecutive display periods, wherein n is the number of light emitting devices in the pixel structure.

In some embodiments, the plurality of light emitting devices connected to a same pixel circuit have a same color; one of the second light emitting control lines to which the pixel circuit is connected is used as a primary light emitting control line, and the remaining second light emitting control lines are used as alternative light emitting control lines;

a valid level signal is provided to the first light emitting control line, the primary light emitting control line, in the light emitting stages of the first m display periods; a valid level signal is provided to the first light emitting control line, the primary light emitting control line and at least one of the alternative light emitting control lines, in the light emitting stages of display periods following the m-th display period; wherein m is determined according to a luminance decay curve of the light emitting device.

In some embodiments, the first reset sub-circuit includes: a first reset transistor, a gate of the first reset transistor is connected to a first reset line, a first electrode of the first reset transistor is connected to the gate of the driving transistor, and a second electrode of the first reset transistor is connected to the initialization signal line;

in the first reset stage, providing a valid level signal to a first reset line to cause the first reset sub-circuit to write a voltage signal on an initialization signal line into the gate of the driving transistor, which specifically includes:

in the first reset stage, providing a valid level signal to the first reset line to connect the first electrode and the second electrode of the first reset line.

In some embodiments, the second reset sub-circuit includes: second reset transistors, respectively; gates of the second reset transistors are connected to the second reset lines, respectively; first electrodes of the second reset transistors are connected to the light emitting devices, respectively; and second electrodes of the second reset transistors are connected to the initialization signal line;

in the second reset stage, providing a valid level signal to at least one second reset line to cause the corresponding second reset sub-circuit to write the voltage on the initialization signal line to the first electrode of the light emitting device, which specifically includes:

in the second reset stage, providing a valid level signal to at least one second reset line to connect the first electrode and the second electrode of the corresponding second reset transistor.

In some embodiments, the first light emitting control sub-circuit includes: a first light emitting control transistor, a gate of the first light emitting control transistor is connected to the first light emitting control line, a first electrode of the first light emitting control transistor is connected to the first power line, and a second electrode of the first light emitting control transistor is connected to the first electrode of the driving transistor; the second light emitting control sub-circuits include: second light emitting control transistors, respectively; gates of the second light emitting control transistors are connected to the second light emitting control lines, respectively; first electrodes of the second light emitting control transistors are connected to the second electrode of the driving transistor; and second electrodes of the second light emitting control transistors are connected to the light emitting device, respectively.

In the light emitting stage, providing a valid level signal to a first light emitting control line and providing a valid level signal to at least one second light emitting control line, so that the first light emitting control sub-circuit causes the first power line and the first electrode of the driving transistor to be directly electrically connected to each other, and the at least one second light emitting control sub-circuit causes the second electrode of the driving transistor and the corresponding light emitting device to be directly electrically connected to each other, which specifically includes:

in the light emitting stage, providing a valid level signal to the first light emitting control line and providing a valid level signal to at least one second light emitting control line, to connect the first electrode and the second electrode of the first light emitting control transistor, and to connect the first electrode and the second electrode of at least one second light emitting control transistor.

In a second aspect, the embodiment of the present disclosure provides a pixel structure, including: a pixel circuit and a plurality of light emitting devices; wherein the pixel circuit includes: a driving transistor, a storage capacitor, a write compensation sub-circuit, a first reset sub-circuit, a first light emitting control sub-circuit, a plurality of second light emitting control sub-circuits, and a plurality of second reset sub-circuits, wherein two terminals of the storage capacitor are respectively connected to a gate of the driving transistor and a first power line; the second light emitting control sub-circuits and the second reset sub-circuits are connected to the light emitting devices in a one-to-one correspondence;

the write compensation sub-circuit is configured to write a voltage signal on a data line to a first electrode of the driving transistor and connect the gate and a second electrode of the driving transistor in response to a signal from a scan line;

the first reset sub-circuit is configured to write a voltage signal on an initialization signal line to the gate of the driving transistor in response to a signal from a first reset line;

the second reset sub-circuit is configured to write a voltage on the initialization signal line to a first electrode of the light emitting device to which the second reset sub-circuit is connected, in response to a signal from the corresponding second reset line;

the first light emitting control sub-circuit is configured to cause the first power line to be directly electrically connected to the first electrode of the driving transistor in response to a signal from a first light emitting control line;

the second light emitting control sub-circuit is configured to causes the second electrode of the driving transistor to be directly connected to the light emitting device to which the second light emitting control sub-circuit is connected, in response to a signal from the corresponding second light emitting control line.

In some embodiments, the second reset sub-circuit includes: second reset transistors, respectively; gates of the second reset transistors are connected to the second reset lines, respectively; first electrodes of the second reset transistors are connected to the light emitting devices, respectively; and second electrodes of the second reset transistors are connected to the initialization signal line;

the second light emitting control sub-circuit includes: a second light emitting control transistor, a gate of which is connected to the second light emitting control line, a first electrode of which is connected to the second electrode of the driving transistor, and a second electrode of which is connected to the light emitting device.

In some embodiments, at least two of the plurality of light emitting devices in the pixel structure have different colors; or, the plurality of light emitting devices in the pixel structure have a same color.

In some embodiments, the number of the light emitting devices in the pixel structure is two, a width-to-length ratio of the driving transistor is between 1/8 and 1/12; or, the number of the light emitting devices in the pixel structure is three, and the width-to-length ratio of the driving transistor is between 1/3 and 1/5.

In a third aspect, the embodiment of the present disclosure provides a display device including a display substrate, a first driving circuit and a second driving circuit, wherein the display substrate includes a plurality of pixels, at least one of which has the pixel structure of any one of claims 8 to 11;

the first driving circuit is configured to: in the first reset stage of the pixel circuit, provide a valid level signal to the first reset line to which the pixel circuit is connected to cause the first reset sub-circuit to write the voltage signal on the initialization signal line into the gate of the driving transistor; in the data write stage of the pixel circuit, provide a valid level signal to the scan line to which the pixel circuit is connected to cause the data write sub-circuit to write the voltage signal on the data line into the first electrode of the driving transistor; and in the second reset stage of the pixel circuit, provide a valid level signal to at least one second reset line to which the pixel circuit is connected to cause the corresponding second reset sub-circuit to write the voltage on the initialization signal line to the first electrode of the light emitting device;

the second driving circuit is configured to: in the light emitting stage of the pixel circuit, provide a valid level signal to the first light emitting control line to which the pixel circuit is connected, and provide a valid level signal to at least one second light emitting control line to which the pixel circuit is connected, so that the first light emitting control sub-circuit causes the first power line to be directly electrically connected to the first electrode of the driving transistor, and at least one second light emitting control sub-circuit causes the second electrode of the driving transistor to be directly electrically connected to the corresponding light emitting device.

In some embodiments, at least two of the plurality of light emitting devices connected to a same pixel circuit have different colors;

the first driving circuit is specifically configured to provide, in the first reset stage, a valid level signal to the first reset line; in the data write stage, provide a valid level signal to the scan line; and in the second reset stage of the pixel circuit, provide a valid level signal to each second reset line, to cause the corresponding second reset sub-circuit to write the voltage on the initialization signal line to the first electrode of the light emitting device;

the second driving circuit is specifically configured to provide a valid level signal to the first light emitting control line and provide a valid level signal to the plurality of second light emitting control lines, respectively, in the light emitting stage.

In some embodiments, the plurality of light emitting devices connected to a same pixel circuit have a same color;

the second driving circuit is specifically configured to provide a valid level signal to the first light emitting control line to which the pixel circuit is connected, in the light emitting stage of each display period; and provide a valid level signal to the n second light emitting control lines to which the pixel circuit is connected by turns in the light emitting stages in n consecutive display periods, wherein n is the number of light emitting devices in the pixel structure.

In some embodiments, the plurality of light emitting devices connected to a same pixel circuit have a same color; one of the second light emitting control lines to which the pixel structure is connected is used as a primary light emitting control line, and the remaining second light emitting control lines are used as alternative light emitting control lines;

the second driving circuit is specifically configured to provide a valid level signal to the first light emitting control line, the primary light emitting control line, in the light emitting stages of the first m display periods; to provide a valid level signal to the first light emitting control line, the primary light emitting control line and at least one of the alternative light emitting control lines, in the light emitting stages of display periods following the m-th display period; wherein m is determined according to luminance decay curves of the light emitting devices to which the pixel circuit is connected.

BRIEF DESCRIPTION OF DRAWINGS

The accompanying drawings, which are included to provide a further understanding of the present disclosure and constitute a part of this specification, are for explaining the present disclosure together with the following exemplary embodiments, but not intended to limit the present disclosure. In the drawings.

DETAIL DESCRIPTION OF EMBODIMENTS

The embodiments of the present disclosure will be described in detail below with reference to the accompanying drawings. It should be understood that detail description of embodiments here is only used to illustrate and explain the present disclosure, but not to limit the present disclosure.

The embodiments of the present disclosure will be described by taking an example in which the light emitting device is an organic light emitting diode (OLED). A first electrode of the light emitting device is an anode, and a second electrode is a cathode.

In addition, transistors in the embodiments of the present disclosure may be independently selected from one of a polycrystalline silicon thin film transistor, an amorphous silicon thin film transistor, an oxide thin film transistor, and an organic thin film transistor. In the present disclosure, a "first electrode" specifically refers to a source of a transistor and a corresponding "second electrode" specifically refers to a drain of the transistor. Alternatively, one skilled in the art will recognize that the "first electrode" and "second electrode" are interchangeable.

In addition, the transistors may be divided into N-type transistors and P-type transistors. Each transistor in the present disclosure may be independently selected from an N-type transistor or a P-type transistor. The following embodiments will be described by taking an example in which the transistors in the display driving circuit are all P-type transistors, and the transistors in the display driving circuit may be simultaneously manufactured by the same manufacturing process. Accordingly, a valid level signal is a low level signal and a invalid level signal is a high level signal.

Figure 1A:
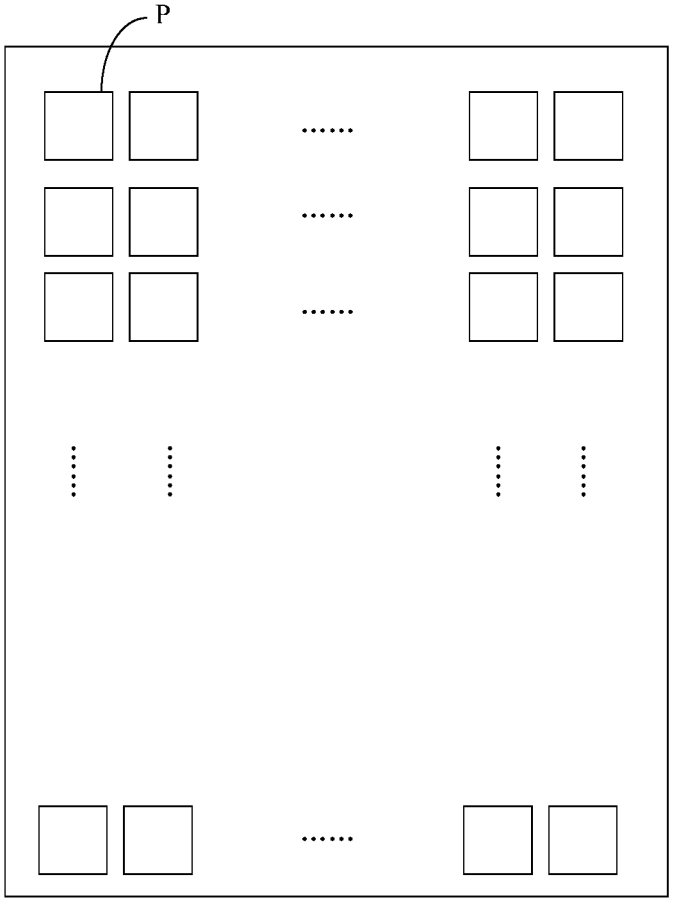
FIG. 1A is a schematic diagram of an exemplary display substrate.

FIG. 1A is a schematic diagram of an exemplary display substrate. As shown in FIG. 1A, a display region of the display substrate includes a plurality of pixels P arranged in an array, each of the plurality of pixels P includes a pixel structure including a pixel circuit and a light emitting device. A driving circuit is provided around the display region, and is configured to provide signals such as scan signals and reset signals to the pixel circuit, and the pixel circuit provides driving current to the light emitting device according to the received signals.

Figure 1B:
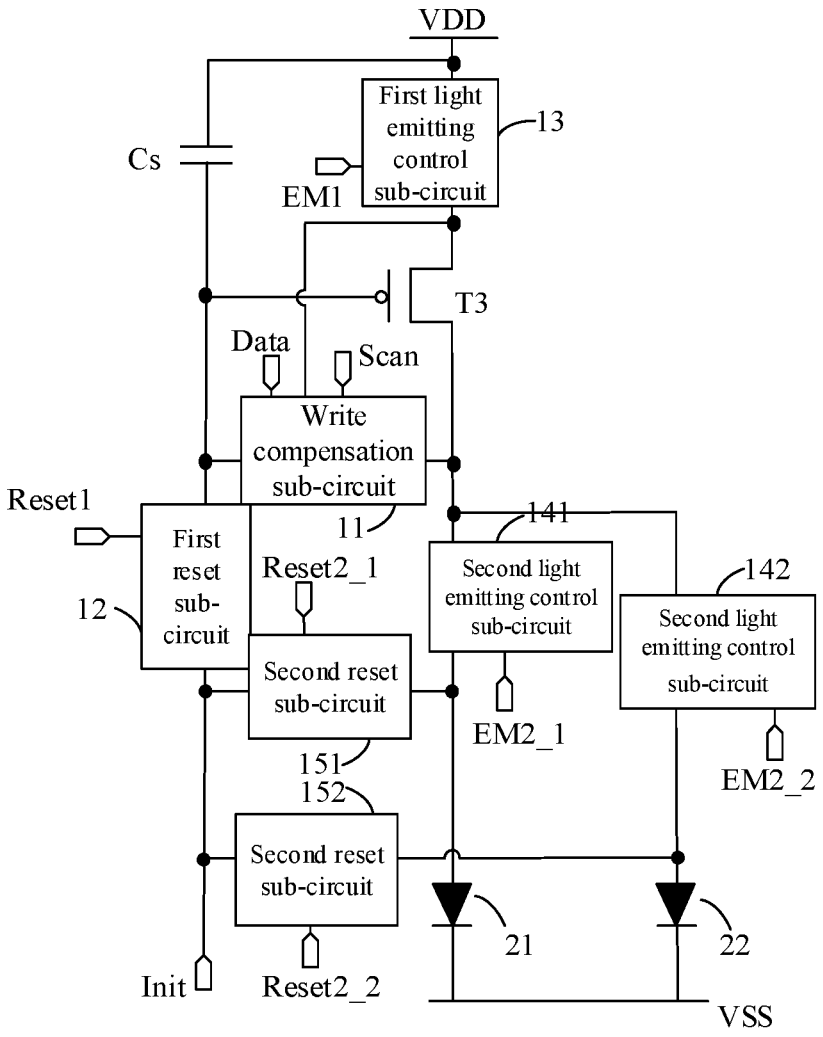
FIG. 1B is a schematic structural diagram of a pixel structure according to an embodiment of the present disclosure.

FIG. 1B is a schematic structural diagram of a pixel structure according to an embodiment of the present disclosure. As shown in FIG. 1B, the pixel structure includes: the pixel circuit and a plurality of light emitting devices 21 to 22. The pixel circuit includes: a driving transistor T3, a storage capacitor Cs, a write compensation sub-circuit 11, a first reset sub-circuit 12, a first light emitting control sub-circuit 13, a plurality of second light emitting control sub-circuits 141 to 142, and a plurality of second reset sub-circuits 151 to 152, wherein two terminals of the storage capacitor Cs are respectively connected to a gate of the driving transistor T3 and a first power line VDD; the second light emitting control sub-circuits 141 to 142 and the second reset sub-circuits 151 to 152 are connected to the light emitting devices 21 to 22 in a one-to-one correspondence. For example, the second light emitting control sub-circuits 141 to 142 and the second reset sub-circuits 151 to 152 are connected to first electrodes of corresponding light emitting devices 21 to 22, and second electrodes of the light emitting devices 21 to 22 are connected to a second power source line VSS. The second reset sub-circuits 151 to 152 are respectively connected to the second reset lines Reset2_1 to Reset2_2. The plurality of second light emitting control sub-circuits 141 to 142 are connected to the plurality of second light emitting control lines EM2_1 to EM2_2, respectively.

The write compensation sub-circuit 11 is configured to connect the gate and a second electrode of the driving transistor T3 together (causes the gate and the second electrode of the driving transistor T3 to be directly electrically connected to each other) in response to a signal from a scan line Scan.

The first reset sub-circuit 12 is configured to write a voltage signal on an initialization signal line Init to the gate of the driving transistor T3 in response to a signal from a first reset line Reset1, thereby resetting a potential at the gate of the driving transistor T3.

The second reset sub-circuit 151/152 is configured to write a voltage on the initialization signal line Init to the first electrode of the light emitting device 21/22 to which the second reset sub-circuit 151/152 is connected, in response to a signal from the corresponding second reset line Reset2_1/Reset 2_2. It should be understood that the second reset lines Reset2_1 and Reset2_1 to which the different second reset sub-circuits 151 and 152 are connected are independent of each other.

The first light emitting control sub-circuit 13 is configured to causes the first power line VDD to be directly electrically connected to a first electrode of the driving transistor T3 in response to a signal from a first light emitting control line EM 1.

The second light emitting control sub-circuit 141/142 is configured to causes the second electrode of the driving transistor T3 to be directly electrically connected to the light emitting device 21/22 to which the second light emitting control sub-circuit 141/142 is connected, in response to a signal from the corresponding second light emitting control line EM2_1/EM2_2. It should be understood that the second light emitting control lines EM2_1 and EM2_2 to which the different second light emitting control sub-circuits 141 and 142 are connected are independent of each other.

Figure 1C:
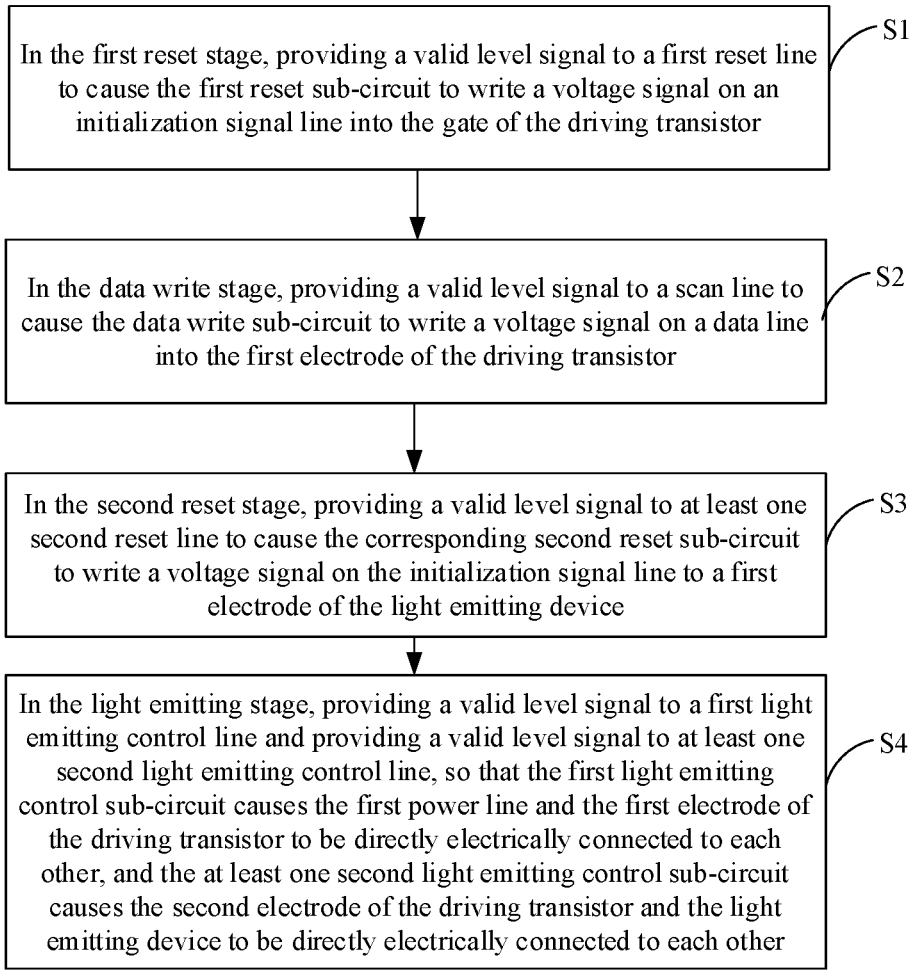
FIG. 1C is a schematic diagram of a driving method for the pixel structure shown in FIG. 1B.

In the embodiment of the present disclosure, the pixel structure has a plurality of display periods, and each display period is a time period for displaying one frame of image on the display substrate. Each display period of the pixel structure may include a first reset stage, a data write stage, a second reset stage, and a light emitting stage. FIG. 1C is a schematic diagram of a driving method for the pixel structure shown in FIG. 1B. As shown in FIG. 1C, the driving method includes:

In the first reset stage, a valid level signal is provided to the first reset line Reset1 to cause the first reset sub-circuit 12 to write the voltage signal on the initialization signal line Init to the gate of the driving transistor T3, thereby resetting the potential at the gate of the driving transistor T3.

In the data write stage, a valid level signal is provided to the scan line Scan to cause the write compensation sub-circuit 11 to write a voltage signal on the data line Data to the first electrode of the driving transistor T3 and to connect the gate and the second electrode of the driving transistor T3 together, so that a voltage stored in the storage capacitor Cs is related to the voltage signal on the data line Data and a threshold voltage of the driving transistor T3.

In the second reset stage, a valid level signal is provided to at least one of the second reset lines Reset2_1/Reset 2_2 to cause the corresponding second reset sub-circuit 151/152 to write the voltage signal on the initialization signal line Init to the first electrode of the light emitting device 21/22, thereby resetting a potential at the first electrode of the light emitting device 21/22.

In the light emitting stage, a valid level signal is provided to the first light emitting control line EM1, and a valid level signal is provided to the at least one of the second light emitting control lines EM2_1 to EM2_2, so that the first light emitting control sub-circuit 13 causes the first power line VDD to be directly electrically connected to the first electrode of the driving transistor T3, and the at least one second light emitting control sub-circuit 141/142 causes the second electrode of the driving transistor T3 to be directly electrically connected to the corresponding light emitting device 21/22, so that the driving transistor T3 provides the driving current to the at least one light emitting device 21/22.

In some examples, at least two of the light emitting devices connected to a same pixel circuit have different colors. For example, the light emitting devices 21 to 22 are a red light emitting device and a green light emitting device, respectively. For another example, the same pixel circuit is connected to one red light emitting device, one green light emitting device, and one blue light emitting device at the same time. For another example, the same pixel circuit is connected to one red light emitting device, two green light emitting devices, and one blue light emitting device at the same time. In this case, in the second reset stage, a valid level signal is provided to each of the second reset lines Reset2_1 to Reset2_2, thereby causing each of the second reset sub-circuits 151/152 to reset the potential at the first electrode of the corresponding light emitting device 21/22. In the light emitting stage, a valid level signal is provided to the first light emitting control line EM1 and is provided to the plurality of second light emitting control lines EM2_1 to EM2_2, respectively, so that the driving transistor T3 provides the driving current to the plurality of light emitting devices 21 to 22. A magnitude of the driving current that the driving transistor T3 may output is related to the voltage stored in the storage capacitor Cs, that is, the voltage signal on the data line Data. When an on time of the second light emitting control sub-circuit 141/142 is long enough, the driving current outputted by the driving transistor T3 may be fully outputted to each light emitting device 21/22; when the on time of the second light emitting control sub-circuit 141/142 is not enough, a magnitude of the current actually flowing through the light emitting device 21/22 is related to the on time of the second light emitting control sub-circuit 141/142. Therefore, by controlling the time of loading the valid level signal on each of the second light emitting control lines EM2_1/EM2_2, the magnitude of the current flowing through the light emitting device 21/22 may be controlled, and thus, the light emitting luminance of the light emitting device 21/22 may be controlled. At this time, the same pixel circuit may simultaneously drive the plurality of light emitting devices 21 to 22 to emit light, thereby facilitating realization of high resolution of the display device.

Alternatively, only one light emitting device 21/22 may be driven to emit light in each display period of the pixel circuit. For example, the plurality of light emitting devices 21 to 22 in each pixel structure have a same color, and the plurality of light emitting devices 21 to 22 are driven by turns to emit light, by providing a valid level signal to the n second light emitting control lines by turns in the light emitting stages in n consecutive display periods (i.e., when displaying n consecutive frames of images). In this way, when a certain region of the display device displays a same image content for a long time, the light emitting devices 21 to 22 in the pixel structures in the region may be controlled to emit light by turns to prevent the display burn-in problem caused by the light emitting device 21/22 in the certain region emitting light for a long time.

In addition, because decay curves of the light emitting devices with different colors are different from each other, decay degrees of the light emitting devices with different colors may appear differences after the display device has been used for a period of time, which easily generates color offset. In the pixel structure of the embodiment of the present disclosure, the pixel circuit may drive the plurality of light emitting devices 21 to 22, so that when the light emitting colors of the plurality of light emitting devices 21 to 22 are the same and are all the colors with the fastest decay speed, one of the light emitting devices 21/22 may be driven to emit light by the pixel circuit in each light emitting stage before the accumulated operation time of the display device reaches a predetermined duration. After the accumulated operation time of the display device reaches the predetermined duration, in each light emitting stage of the pixel structure, the at least two light emitting devices 21 to 22 are driven by the pixel circuit to emit light simultaneously, thereby compensating the luminance decay of the light emitting device 21/22.

Figure 2:
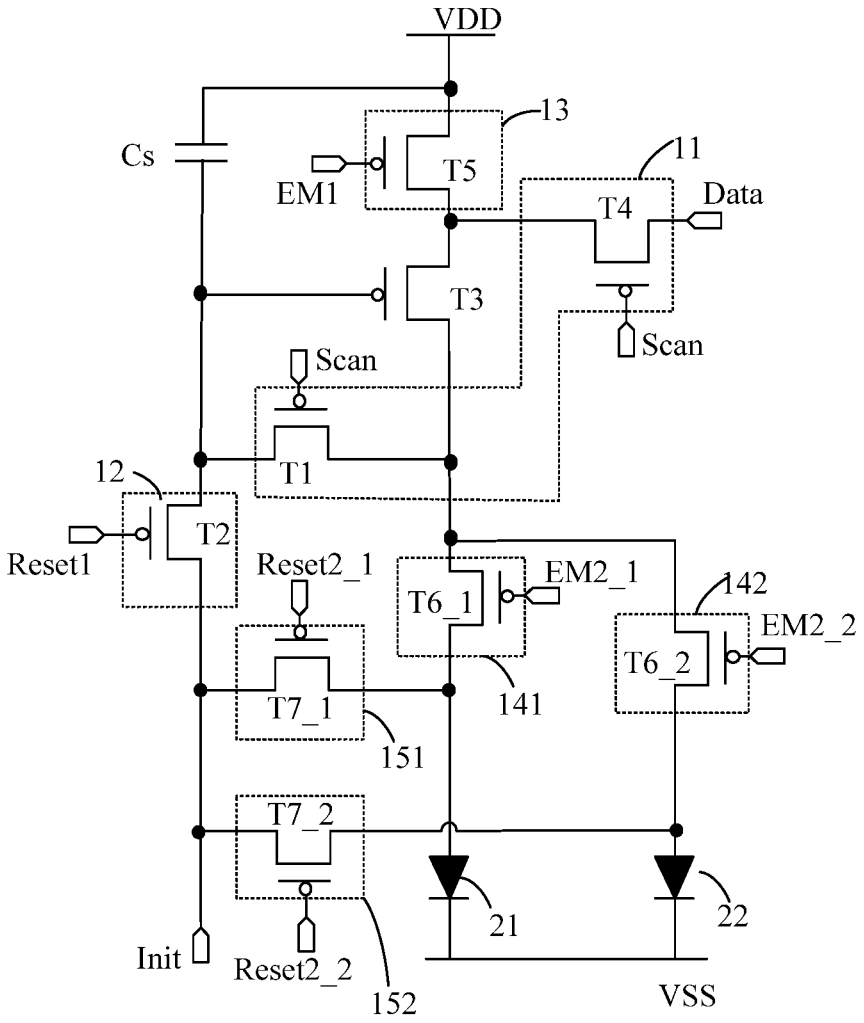
FIG. 2 is a schematic diagram of a pixel structure according to an embodiment of the present disclosure.

FIG. 2 is a schematic diagram of another pixel structure provided in an embodiment of the present disclosure. The pixel structure shown in FIG. 2 is an embodiment based on the pixel structure shown in FIG. 1B. As shown in FIG. 2, in some embodiments, the write compensation sub-circuit 11 includes: a data write transistor T4 and a compensation transistor T1, a gate of the data write transistor T4 is connected to the scan line Scan, a first electrode of the data write transistor T4 is connected to the data line Data, and a second electrode of the data write transistor T4 is connected to the first electrode of the driving transistor T3. A gate of the compensation transistor T1 is connected to the scan line Scan, a first electrode of the compensation transistor T1 is connected to the second electrode of the driving transistor T3, and a second electrode of the compensation transistor T3 is connected to the gate of the driving transistor T3.

In some embodiments, the first reset sub-circuit 12 includes: a first reset transistor T2, a gate of the first reset transistor T2 is connected to a first reset line Reset1, a first electrode of the first reset transistor T2 is connected to the gate of the driving transistor T3, and a second electrode of the first reset transistor T2 is connected to the initialization signal line Init. In the first reset stage, the first reset sub-circuit 12 writes a voltage signal on the initialization signal line Init to the gate of the driving transistor T3, specifically, which means that the first electrode and the second electrode of the first reset transistor T2 are turned on, so that the gate of the driving transistor T3 and the initialization signal line Init are turned on.

In some embodiments, the second reset sub-circuits 151/152 includes: second reset transistors T7_1/T7_2, respectively; gates of the second reset transistors T7_1/T7_2 are connected to the second reset lines Reset2_1/Reset 2_2, respectively; first electrodes of the second reset transistors T7_1/T7_2 are connected to first electrodes of the light emitting devices 21/22, respectively; and second electrodes of the second reset transistors T7_1/T7_2 are connected to the initialization signal line Init. In the second reset stage, the second reset sub-circuits 151/152 write the voltage signal on the initialization signal line Init into first electrodes of the light emitting devices 21/22, specifically, which means that first electrodes and second electrodes of the second reset transistors T7_1/T7_2 are turned on, so that the first electrodes of the light emitting devices 21/22 and the initialization signal line Init are turned on.

In some embodiments, the first light emitting control sub-circuit 13 includes: a first light emitting control transistor T5, a gate of the first light emitting control transistor T5 is connected to the first light emitting control line EM1, a first electrode of the first light emitting control transistor T5 is connected to the first power line VDD, and a second electrode of the first light emitting control transistor T5 is connected to the first electrode of the driving transistor T3. In the light emitting stage, the first light emitting control sub-circuit 13 makes the first power line VDD be directly electrically connected to the first electrode of the driving transistor T3, which specifically means that the first electrode and the second electrode of the first light emitting control transistor T5 are connected to each other, so that the first power line VDD is directly electrically connected to the first electrode of the driving transistor T3.

In some embodiments, the second light emitting control sub-circuits 141/142 include:

second light emitting control transistors T6_1/T6_2, respectively; gates of the second light emitting control transistors T6_1/T6_2 are connected to the second light emitting control lines EM2_1/EM2_2, respectively; first electrodes of the second light emitting control transistors T6_1/T6_2 are connected to the second electrode of the driving transistor T3; and second electrodes of the second light emitting control transistors T6_1/T6_2 are connected to the light emitting device 21/22, respectively. In the light emitting stage, the second light emitting control sub-circuit 141/142 makes the second electrode of the driving transistor T3 be directly electrically connected to the corresponding light emitting device 21/22, which specifically means that the second light emitting control transistor T6_1/T6_2 is turned on, thereby causing the second electrode of the driving transistor T3 to be directly electrically connected to the corresponding light emitting device 21/22.

In some embodiments, the at least two second reset transistors T7_1 to T7_2 form a dual gate structure, thereby reducing a space occupied by the pixel structure. For example, in the case that the pixel structure in FIG. 2 includes two second reset transistors T7_1 to T7_2, the two second reset transistors T7_1 to T7_2 form a dual gate transistor, the dual gate transistor has two gates, two first electrodes and one second electrode, the two gates of the dual gate transistor respectively serve as the gates of the two second reset transistors T7_1 to T7_2, the two first electrodes of the dual gate transistor respectively serve as the first electrodes of the two second reset transistors T7_1 to T7_2, and the second gate of the dual gate transistor simultaneously serves as the second electrodes of the two second reset transistors T7_1/T7_2.

Figure 3:
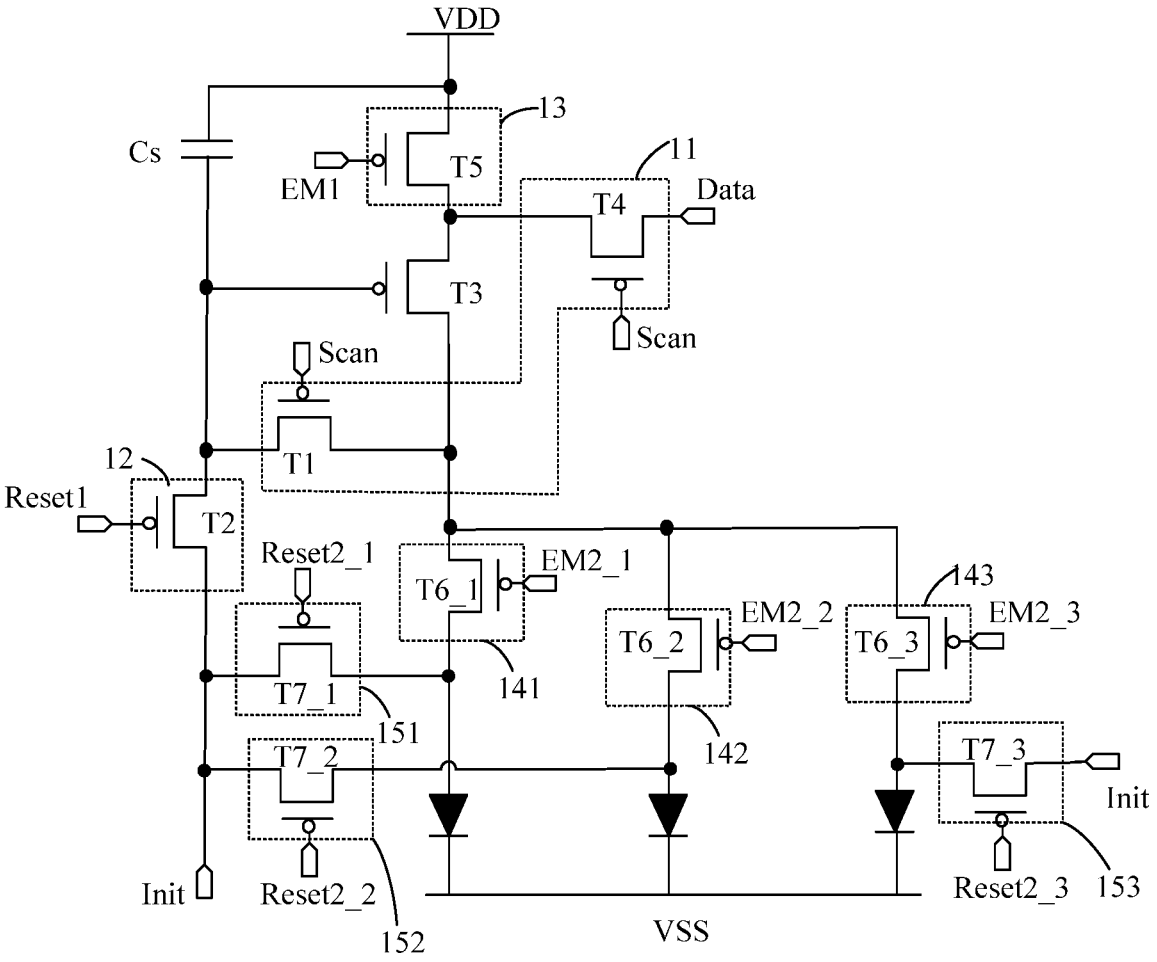
FIG. 3 is a schematic diagram of a pixel structure according to an embodiment of the present disclosure.

FIG. 3 is a schematic diagram of another pixel structure provided in an embodiment of the present disclosure. The difference between the pixel structure shown in FIG. 3 and the pixel structure shown in FIG. 2 is only: in FIG. 2, the pixel structure includes two light emitting devices 21 to 22, two second reset sub-circuits 151 to 152, and two second light emitting control sub-circuits 141 to 142; in FIG. 3, the pixel structure includes three light emitting devices 21 to 23, three second reset sub-circuits 151 to 153, and three second light emitting control sub-circuits 141 to 143. It should be noted that the number of the light emitting devices 21/22/23, the second reset sub-circuit 151/152/153, and the second light emitting control sub-circuit 141/142/143 may also be set to other numbers, which is not limited herein.

For the pixel structure shown in FIG. 3, two of the second reset transistors T7_1 to T7_2 may be used to constitute a dual-gate transistor, and the other second reset transistor T7_3 is a single transistor.

A driving process for the pixel structure in the embodiment of the present disclosure will be described below in detail by taking the pixel structure shown in FIG. 3 as an example.

Figure 4:
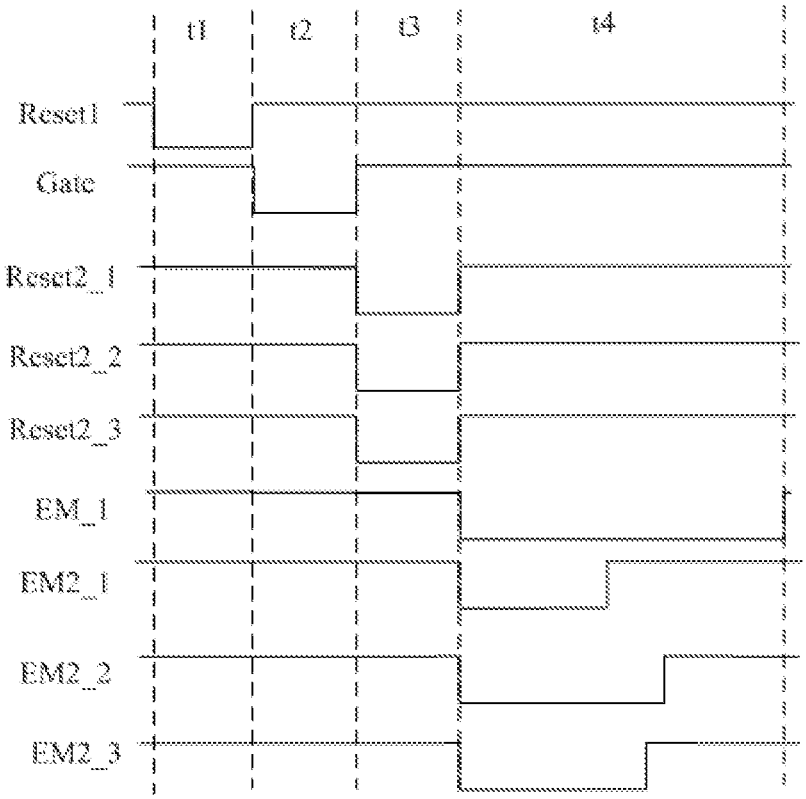
FIG. 4 is a timing diagram illustrating an operation of a pixel structure according to an embodiment of the present disclosure.

In some embodiments, the light emitting colors of the plurality of light emitting devices 21 to 23 in the pixel structure may be different from each other. For example, the light emitting colors of the light emitting devices 21 to 23 in FIG. 3 are red, green and blue, respectively. In this case, the operation timing of the pixel structure may be as shown in FIG. 4. The driving process for the pixel structure includes: a first reset stage t1, a data write stage t2, a second reset stage t3, and a light emitting stage t4.

In the first reset stage t1, a valid level signal is provided to the first reset line Reset1, and an invalid level signal is provided to the scan line Scan, the second reset line Reset2_1/Reset2_2, the first light emitting control line EM1, and the second light emitting control line EM2_1/EM2_2. At this time, the first reset transistor T2 is turned on, and the voltage signal on the initialization voltage line Init is transmitted to the gate of the driving transistor T3, thereby resetting the potential at the gate of the driving transistor T3. The data write transistor T4, the compensation transistor T1, the first light emitting control transistor T5, the second light emitting control transistors T6_1 to T6_3, and the second reset transistors T7_1 to T7_3 are all turned off.

In the data write stage t2, a valid level signal is provided to the scan line Scan, and an invalid level signal is provided to the first reset line Reset1, the second reset lines Reset2_1 to Reset2_3, the first light emitting control line EM1, and the second light emitting control lines EM2_1 to EM2_3. At this time, the data write transistor T4 is turned on, and the voltage signal on the data line Data is written into the first electrode of the driving transistor T3; meanwhile, the compensation transistor T1 is turned on, so that the gate and the second electrode of the driving transistor T3 are short connected with each other, forming a diode. At this time, the voltage signal on the data line Data passes through the driving transistor T3 and the compensation transistor T1, and flows to the gate of the driving transistor T3, such that the potential at the gate of the driving transistor T3 reaches Vdata+Vth, where Vth is the threshold voltage of the driving transistor T3, and Vdata is the voltage on the data line Data.

In the second reset stage t3, a valid level signal is provided to the second reset lines Reset2_1 to Reset2_3. An invalid level signal is provided to the first reset line Reset1, the scan line Scan, the first light emitting control line EM1, and the second light emitting control lines EM2_1 to EM2_3. At this time, the plurality of second light emitting control transistors T6_1 to T6_3 are all turned on, so that the voltage signal on the initialization signal line Init is transmitted to the first electrode of each of the light emitting devices 21 to 23 to reset the potential at the first electrode of each of the light emitting devices 21 to 23.

In the light emitting stage t4, an invalid level signal is provided to the first reset line Reset1, the second reset lines Reset2_1 to Reset2_3, and the scan line Scan, and a valid level signal is provided to the first light emitting control line EM1 and the plurality of second light emitting control lines EM2_1 to EM2_3, respectively. It is noted that the valid level signals provided to the plurality of second light emitting control lines EM2_1 to EM2_3 are independent of each other. At this time, the first light emitting control transistor T5 is turned on, and each of the second light emitting control transistors T6_1/T6_2/T6_3 is turned on when the corresponding one of the second light emitting control lines EM2_1/EM2_2/EM2_3 is loaded with a valid level, thereby causing each of the plurality of light emitting devices 21 to 23 to emit light. Specifically, the potential at the gate of the driving transistor T3 is held at Vdata+Vth under the voltage holding action of the storage capacitor Cs. When any one of the second light emitting control transistors T6_1/T6_2/T6_3 is turned on, the driving transistor T3 outputs the driving current. When the on time of the second light emitting control transistor T6_1/T6_2/T6_3 reaches a certain time, the driving current $I_{OLED}$ flowing through the light emitting devices 21/22/23 satisfies the following saturation current formula:

$$I_{OLED} = K(Vgs - Vth)^2 = K(Vdata + Vth - ELVDD - Vth)^2 = K(Vdata - ELVDD)^2$$

where K is a coefficient related to characteristics of the driving transistor T3, Vgs is a gate source voltage of the driving transistor T3, i.e., a voltage between the gate and the first electrode of the driving transistor T3, and ELVDD is a voltage provided by the first power line VDD.

When the on time of the second light emitting control transistor T6_1/T6_2/T6_3 is less than a certain time, the current flowing through the light emitting device 21/22/23 is less than the above $I_{OLED}$, and is related to the $I_{OLED}$ and the on time of the second light emitting control transistor T6_1/T6_2. Thus, by controlling the time when the second light emitting control line EM2_1/EM2_2/EM2_3 is loaded with the valid level signal, and the above Vdata, a magnitude of the current flowing through the light emitting device 21/22/23 may be controlled. That is, in the light emitting stage t4, a valid level signal is not continuously provided to each of the second light emitting control lines EM2_1/EM2_2/EM2_3.

In other embodiments, the plurality of light emitting devices 21-23 in the pixel structure may emit light of the same color. In this case, the operation timing of the pixel structure may be shown in FIG. 5. The operation process of the pixel structure also includes: a first reset stage t1, a data write stage t2, a second reset stage t3, and a light emitting stage t4.

In the first reset stage t1, a valid level signal is provided to the first reset line Reset1, and an invalid level signal is provided to the scan line Scan, the second reset lines Reset2_1 to Reset2_3, the first light emitting control line EM1, and the second light emitting control lines EM2_1 to EM2_3. At this time, the first reset transistor T2 is turned on, and the voltage signal on the initialization signal line Init is transmitted to the gate of the drive transistor T3, thereby resetting the potential at the gate of the drive transistor T3. The data write transistor T4, the compensation transistor T1, the first light emitting control transistor T5, the second light emitting control transistors T6_1 to T6_3, and the second reset transistors T7_1 to T7_3 are all turned off.

In the data write stage t2, a valid level signal is provided to the scan line Scan, and an invalid level signal is provided to the first reset line Reset1, the second reset lines Reset2_1 to Reset2_3, the first light emitting control line EM1, and the second light emitting control lines EM2_1 to EM2_3. At this time, the data write transistor T4 is turned on, and the voltage signal on the data line Data is written into the first electrode of the driving transistor T3; the compensation transistor T1 is turned on, so that the gate of the driving transistor T3 is shorted connected with the second electrode, forming a diode. At this time, the voltage signal on the data line Data passes through the driving transistor T3 and the compensation transistor T1, and flows to the gate of the driving transistor T3, and the potential at the gate of the driving transistor T3 reaches Vdata+Vth, where Vth is the threshold voltage of the driving transistor T3, and Vdata is the voltage on the data line Data.

In the second reset stage t3, a valid level signal is provided to at least one second reset line Reset2_1, and an invalid level signal is provided to the first reset line Reset1, the scan line Scan, the first light emitting control line EM1, and the second light emitting control lines EM2_1 to EM2_3. At this time, at least the second reset transistor T7_1 is turned on, to at least transmit the voltage signal on the initialization signal line Init to the first electrode of the light emitting device 21 and to reset at least the potential at the first electrode of one of the light emitting devices 21.

In the light emitting stage t4, an invalid level signal is provided to the first reset line Reset1, the second reset lines Reset1_1 to Reset1_3, and the scan line Scan, and a valid level signal is continuously provided to the first light emitting control line EM1 and one of the second light emitting control lines EM2_1. At this time, the first light emitting control transistor T5 is turned on, and one of the second light emitting control transistors T6_1 is turned on. The potential at the gate of the driving transistor T3 is held at Vdata+Vth under the voltage holding action of the storage capacitor Cs. The current output by the driving transistor T3 to the corresponding light emitting device 21 reaches the driving current $I_{OLED}$ described above.

In each display period, the operation process of the pixel structure includes the above four stages, and in the light emitting stages of three consecutive (i-th to (i+2)th) display periods, valid level signals may be provided to the three second light emitting control lines EM2_1 to EM2_3 by turns, so that the three light emitting devices 21 to 23 in the pixel structure work in the three display periods by turns, to prevent the display burn-in caused by the single light emitting device 21/22/23 working for a long time. The display period may be a display stage of one frame of display picture. Alternatively, the display period may also be a display stage of two or other frames of display pictures.

Figure 5:
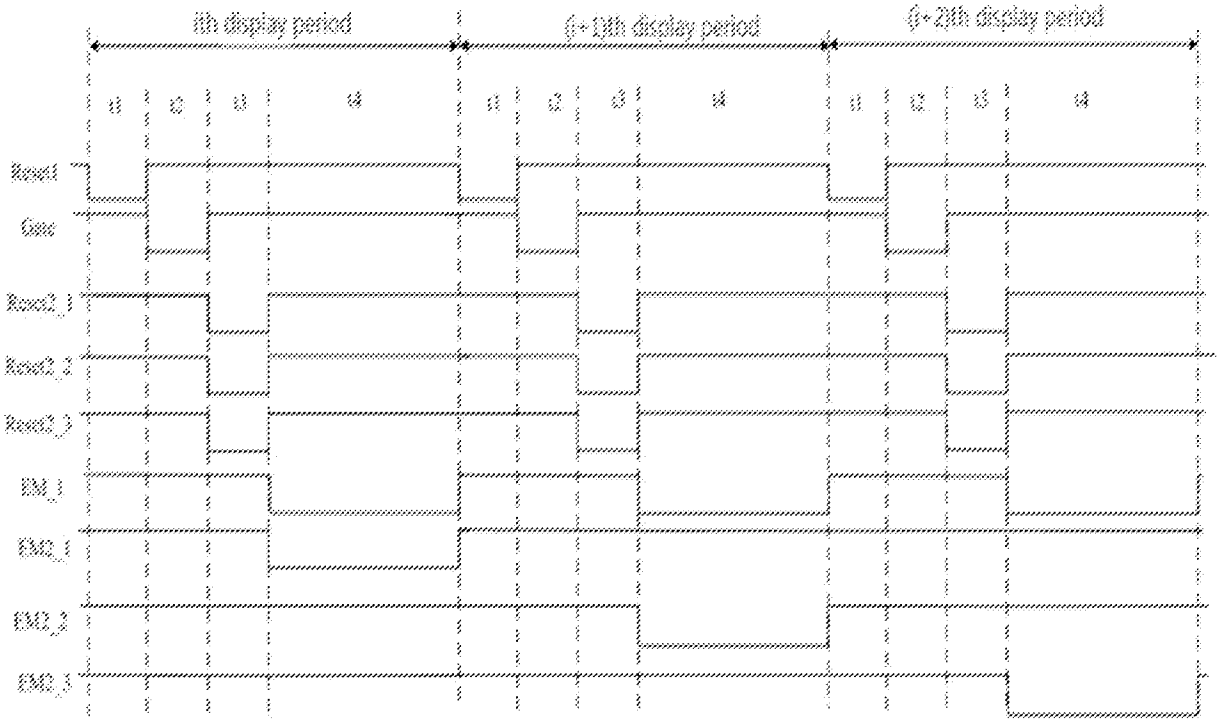
FIG. 5 is a timing diagram illustrating an operation of a pixel structure according to an embodiment of the present disclosure.

Note that in a second reset stage t3 in FIG. 5, a valid level signal is provided to each of the second reset lines Reset2_1 to Reset2_3. However, in practice, it is not necessary to provide a valid level signal to all of the second reset lines Reset2_1 to Reset2_3. For example, if a valid level signal is provided to the second light emitting control line EM2_1 to control the light emitting device 21 to emit light in the light emitting stage of the ith display period, at least a valid level signal is provided to the second reset line Reset2_1 corresponding to the light emitting device 21 in the reset stage t3 of the ith display period. If a valid level signal is provided to the second light emitting control line EM2_2 to control the light emitting device 22 to emit light in the light emitting stage t4 of the (i+1)th display period, at least a valid level signal is provided to the second reset line Reset2_2 corresponding to the light emitting device 22 in the reset stage t3 of the (i+1)th display period.

It should be noted that the operation timing shown in FIG. 5 is illustrated by taking the pixel structure in FIG. 3 as an example; the number of the light emitting devices in the pixel structure may also be other numbers, and it is only necessary to provide a valid level signal to the n second light emitting control lines by turns in light emitting stages in n consecutive display periods, so that the n light emitting devices emit light by turns in the n display periods, where n is the number of light emitting devices in the pixel structure.

Figure 6:
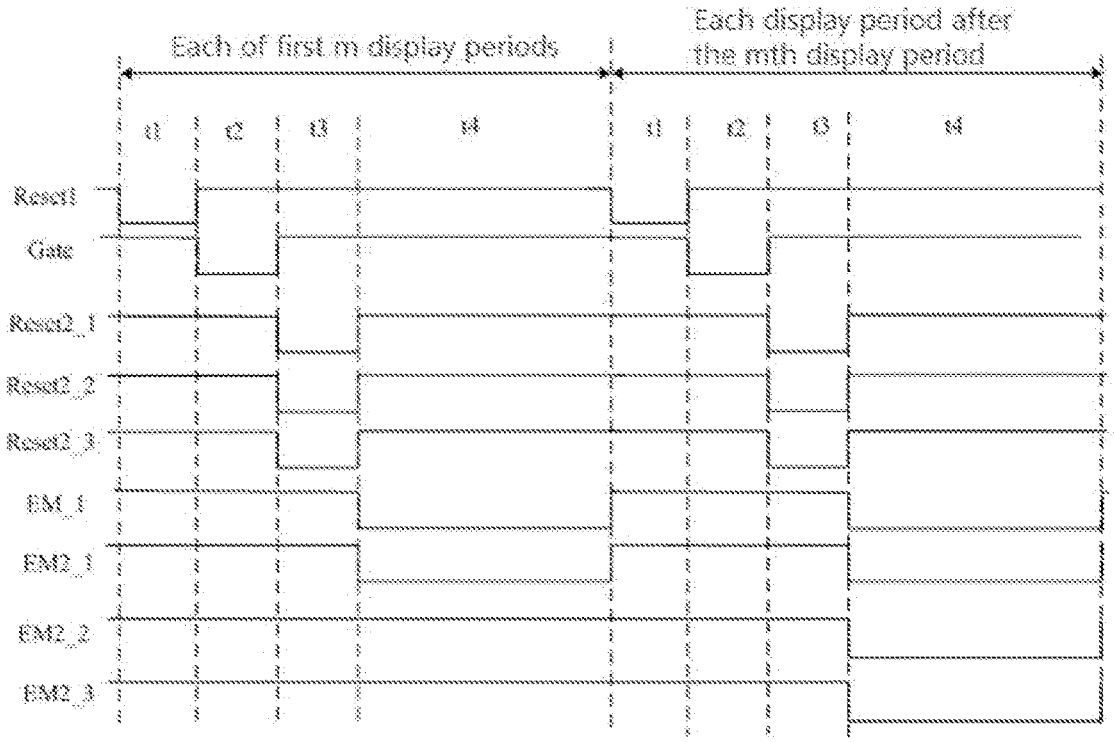
FIG. 6 is a timing diagram illustrating an operation of a pixel structure according to an embodiment of the present disclosure.

The operation timing of the pixel structure may also be shown in FIG. 6 for the case where the light emitting colors of the plurality of light emitting devices 21 to 23 in the pixel structure are the same.

As with the operation timing in FIG. 5, in the first reset stage T1, a valid level signal is provided to the first reset line Reset1, an invalid level signal is provided to the scan line Scan, the second reset lines Reset2_1 to Reset2_3, the first light emitting control line EM1, and the second light emitting control lines EM2_1 to EM2_3, such that the first reset transistor T2 is turned on to reset the potential at the gate of the driving transistor T3. In the data write stage T2, a valid level signal is provided to the scan line Scan, and an invalid level signal is provided to the first reset line Reset1, the second reset lines Reset2_1 to Reset2_3, the first light emitting control transistor T5, and the second light emitting control transistors T6_1 to T6_3. The potential at the gate of the driving transistor T3 reaches Vdata+Vth. In the second reset stage t3, a valid level signal is provided to at least one second reset line Reset2_1/Reset2_2/Reset2_3, and the voltage signal on the initialization signal line Init is transmitted to the first electrode of the corresponding light emitting device 21/22/23 to reset the potential at the first electrode of the at least one light emitting device 21/22/23.

One of the second light emitting control lines EM2_1 to which the pixel structure in FIG. 3 is connected is used as a primary light emitting control line, and the remaining second light emitting control lines EM2_2 to EM2_3 are used as alternative light emitting control lines. The difference between the operation processes shown in FIG. 6 and in FIG. 5 is: as shown in FIG. 6, in the light emitting stages t4 of the first m display periods, an invalid level signal is provided to the first reset line Reset1, the second reset lines Reset2_1 to Reset2_3, and the scan line Scan, and a valid level signal is provided to the first light emitting control line EM1 and the second light emitting control line EM2_1 (i.e., the light emitting control line of interest). At this time, the first light emitting control transistor T5 is turned on, and the second light emitting control transistor T6_1 is turned on, thereby providing the driving current to the light emitting device 21. Since the luminance of the light emitting device 21 is decayed after m display periods, the other light emitting devices 22 and/or 23 may be controlled to emit light, to compensate the luminance decay of the light emitting device 21 in the light emitting stages t4 of the (m+1)th and subsequent display periods. Specifically, in the light emitting stages t4 of the (m+1)th and subsequent display periods, an invalid level signal is provided to the first reset line Reset1, the second reset lines Reset2_1 to Reset2_3, the scan line Scan, and a valid level signal is provided to the first light emitting control line EM1, and at least one alternative light emitting control line (i.e., at least one of EM2_2 and EM2_3). At this time, the first light emitting control transistor T5 is turned on, the second light emitting control transistor T6_1 is turned on, and at least one of the second light emitting control transistors T6_2 and/or T6_3 is turned on, thereby controlling at least one of the light emitting devices 22 and 23 and the light emitting device 21 to emit light. The duration of providing the valid level signal to the alternative light emitting control line may be determined according to the required luminance of the light emitting device 22/23.

In any display period, if one or more light emitting devices need to be controlled to emit light in the light emitting stage t4, in the second reset stage t3, a valid level signal is provided to the second reset line corresponding to the light emitting device which is to emit light, so as to reset the potential at the first electrode of the light emitting device which is to emit light.

Figure 7:
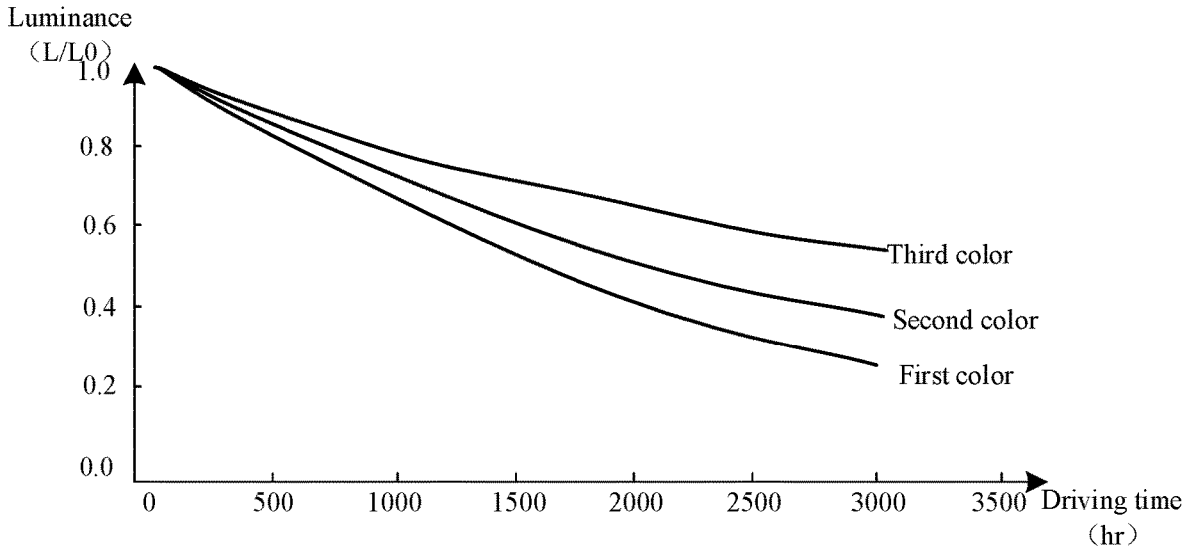
FIG. 7 is a diagram showing luminance decay curves of light emitting devices having different colors.

The first m display periods may be the first m display periods of the accumulated operating of the pixel structure, that is, the first m display periods of the accumulated displaying of the display device; and m may be determined according to the luminance decay curve of the light emitting device. For example, in the display device, a sub-pixel of a first color (for example, blue), a sub-pixel of a second color (for example, red), and a sub-pixel of a third color (for example, green) may be provided. FIG. 7 is a diagram showing luminance decay curves of light emitting devices having different colors. As shown in FIG. 7, a decay speed of the light emitting device of the first color is greater than a decay speed of the light emitting device of the second color. In this case, the above pixel structure may be provided in the sub-pixel of the first color. If a difference between a degree of the luminance decay of the light emitting device of the first color and a degree of the luminance decay of the light emitting device of the other colors reaches a preset value, an accumulated operation time of the light emitting device of the first color is time1, m is a number of display periods corresponding to an accumulated display time of the display device being time1. Alternatively, the above pixel structure may be provided in both the sub-pixels of the first color and the second color. For example, as shown in FIG. 7, when the driving time reaches 500 hours (hr), the light emitting luminance of the light emitting devices of the first color and the second color may significantly decay. For this case, at least two light emitting devices of the first color in the pixel circuit may be controlled to simultaneously emit light in the light emitting stage of the pixel circuit in the sub-pixel of the first color after the accumulated display time of the display device reaches 500 hours; and at least two light emitting devices of the second color in the pixel circuit may be controlled to simultaneously emit light in the light emitting stage of the pixel circuit in the sub-pixel of the second color.

In some embodiments, a value of the driving current that may be output by the driving transistor T3 may be increased by adjusting a width-to-length ratio of the driving transistor T3, thereby satisfying the requirement that two or more light emitting devices emit light simultaneously. In some examples, when the number of the light emitting devices connected to a same pixel circuit is two, and the width-to-length ratio of the driving transistor T3 is between 1/8 to 1/12 (for example, 3/30), the current value that may be output by the driving transistor T3 is 200 nA; in other examples, the number of the light emitting devices connected to a same pixel circuit is three, the width-to-length ratio of the driving transistor is between 1/3 to 1/5 (for example, 5/20), and the current value that may be output by the driving transistor T3 may reach 300 nA. In addition, a voltage difference between the first power line VDD and the second power line VSS may be increased to further increase the driving current that may be output by the driving transistor T3. For example, the voltage of the first power line VDD is between 4V and 5V, for example, 4.6V; the voltage of the second power line VSS is between −4V and −6V, for example, −5V.

It should be noted that the above embodiments are described by taking an example in which the operation process of the pixel structure includes two reset stages (i.e. the first reset stage t1 and the second reset stage t3). In practice, the first reset stage t1 and the second reset stage t3 of the pixel structure may be merged. That is, a valid level signal is simultaneously provided to the first reset line Reset1 and at least one second reset line Reset2_1/Reset2_2/Reset2_3 before the data write stage t2.

Figure 8:
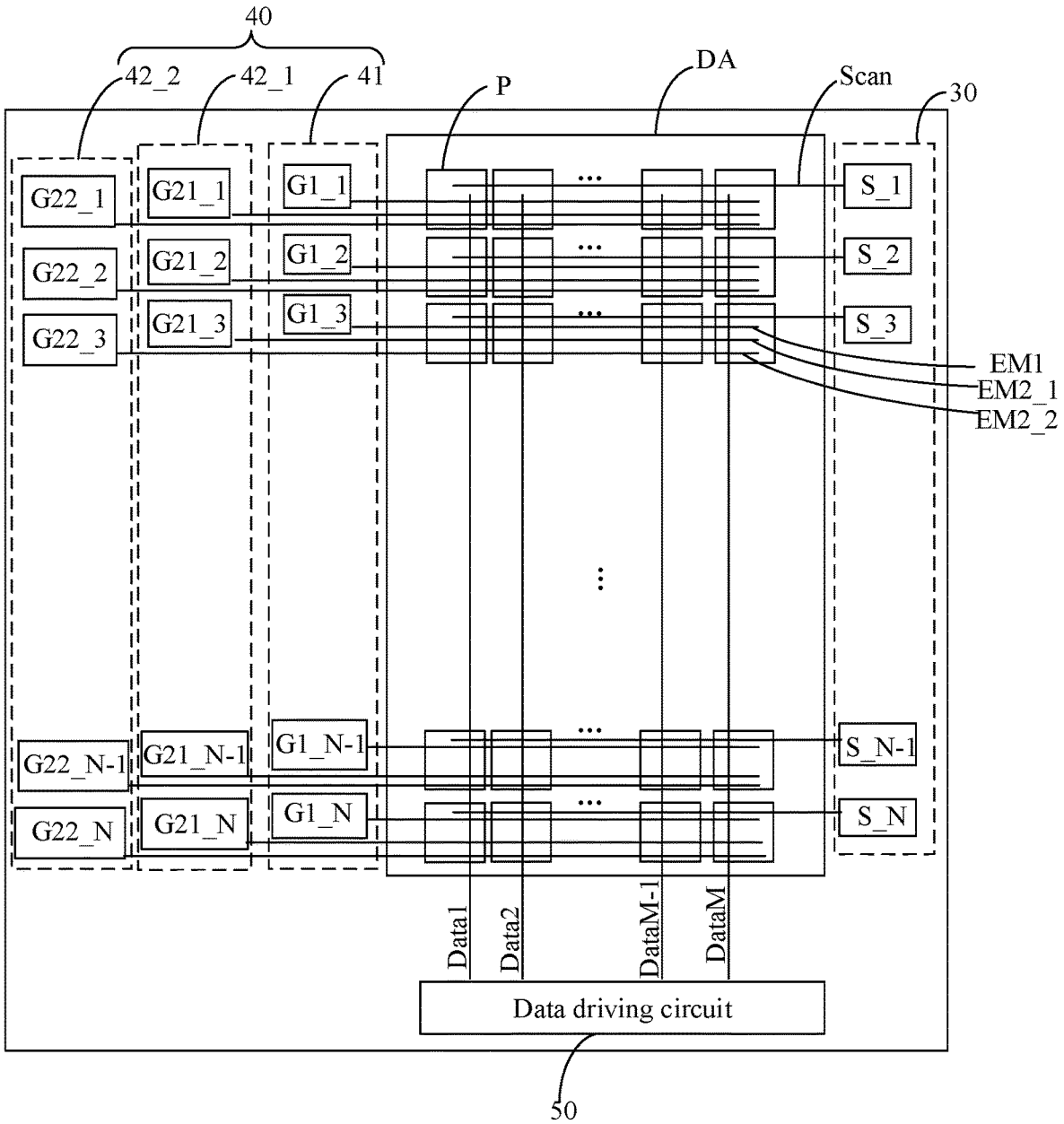
FIG. 8 is a schematic diagram of an overall architecture of a display device according to an embodiment of the present disclosure.

An embodiment of the present disclosure also provides a display device. FIG. 8 is a schematic diagram of an overall architecture of the display device according to an embodiment of the present disclosure. As shown in FIG. 8, the display device includes a display substrate, a first driving circuit 30, and a second driving circuit 40. The display substrate includes a display region DA and a peripheral region at the periphery of the display region DA, and the first driving circuit 30 and the second driving circuit 40 may be disposed in the peripheral region of the display substrate. The display region DA includes a plurality of pixels P arranged in an array, and the pixel structure in the above-described embodiment is disposed in at least one of the pixels P. The plurality of light emitting devices in the same pixel structure may be arranged in a row direction or a column direction.

In some embodiments, the pixel structure in the above embodiments is disposed in each pixel P, pixel structures in a same row are connected to a same scan line Scan; pixel structures in a same row are connected to a same first reset line; pixel structures in a same row are connected to a same second reset line; pixel structures in a same row are connected to a same first light emitting control line EM1. Taking the number of the light emitting devices in the pixel structure being two as an example, pixel structures in a same row are connected to a same second light emitting control line EM2_1; pixel structures in a same row are connected to a same second light emitting control line EM2_2. Pixel structures in a same column are connected to a same data line. The data lines Data1 to DataM connected to pixel structures in a plurality of columns are connected to the data driving circuit 50, so as to receive the data voltage signal provided by the data driving circuit 50.

The first driving circuit 30 is configured to: in the first reset stage of the pixel circuit, provide a valid level signal to the first reset line to which the pixel circuit is connected to cause the first reset sub-circuit to write the voltage signal on the initialization signal line into the gate of the driving transistor; in the data write stage of the pixel circuit, provide a valid level signal to the scan line to which the pixel circuit is connected to cause the data write sub-circuit to write the voltage signal on the data line into the first electrode of the driving transistor; and in the second reset stage of the pixel circuit, provide a valid level signal to at least one second reset line to which the pixel circuit is connected to cause the corresponding second reset sub-circuit to write the voltage on the initialization signal line to the first electrode of the light emitting device.

Alternatively, the first driving circuit 30 may specifically include a plurality of cascaded gate driving units. For example, as shown in FIG. 8, the first driving circuit 30 includes: a first-stage gate driving unit S_1, a second-stage gate driving unit S_2, a third-stage gate driving unit S_3 . . . , a (N−1)th-stage gate driving unit S_N−1 and a Nth-stage gate driving unit S_N. The first-stage gate driving unit S_1 is connected to the scan line to which pixel circuits in a first row are connected, and is configured to provide a scan signal in a valid level state to pixel circuits in the first row in the data write stage of pixel circuits in the first row; the first-stage gate driving circuit S_1 is connected to the first reset line to which pixel circuits in a second row are connected, so as to provide the first reset signal in a valid level state to pixel circuits in the second row in the first reset stage of pixel circuits in the second row. The second-stage gate driving unit S_2 is connected to the scan line to which pixel circuits in the second row are connected, and is configured to provide a scan signal in a valid level state to pixel circuits in the second row in the data write stage of pixel circuits in the second row; the second-stage gate driving unit S_2 is connected to the second reset line to which pixel circuits in the first row are connected and the first reset line to which pixel circuits in the third row are connected, so as to provide a second reset signal in a valid level state to pixel circuits in the first row in the second reset stage of pixel circuits in the first row, and to provide a first reset signal in a valid level state to pixel circuits in the first row in the first reset stage of pixel circuits in the third row. The (N−1)th-stage gate driving unit S_N−1 is connected to the scan line to which pixel circuits in an (N−1)th row are connected, so as to provide a scan signal in a valid level state to pixel circuits in the (N−1)th row in the data write stage of pixel circuits in the (N−1)th row; the (N−1)th-stage gate driving unit S_N−1 is connected to the second reset line to which pixel circuits in an (N−2)th row are connected and the first reset line to which pixel circuits in an Nth row are connected, so as to provide a second reset signal in a valid level state to pixel circuits in the (N−2)th row in the second reset stage of pixel circuits in the (N−2)th row, and to provide a first reset signal in a valid level state to the pixel circuits in the Nth row in the first reset stage of the pixel circuits in the Nth row. The Nth-stage gate driving unit S_N is connected to the scan line to which pixel circuits in the Nth row are connected, so as to provide a scan signal in a valid level state to the pixel circuits in the Nth row in the data write stage of the pixel circuits in the Nth row; the Nth-stage gate driving unit S_N is connected to the second reset line to which pixel circuits in the (N−1)th row are connected, so as to provide a second reset signal in a valid level state to pixel circuits in the (N−1)th row in the second reset stage of pixel circuits in the (N−1)th row.

The second driving circuit 40 is configured to: in the light emitting stage of the pixel circuit, provide a valid level signal to the first light emitting control line EM1 to which the pixel circuit is connected, and provide a valid level signal to at least one second light emitting control line EM2_1/EM2_2 to which the pixel circuit is connected, so that the first light emitting control sub-circuit causes the first power line to be directly electrically connected to the first electrode of the driving transistor, and at least one second light emitting control sub-circuit causes the second electrode of the driving transistor to be directly electrically connected to the corresponding light emitting device.

Alternatively, the second driving circuit 40 may include a first shift register 41 and a plurality of second shift registers 42_1 to 42_2, which are in one-to-one correspondence with the second light emitting control lines EM2_1/EM2_2 to which the pixel circuits in a same row are connected. A structure of the second driving circuit 40 will be described below by taking an example in which pixel circuits in a same row are connected to two second light emitting control lines EM2_1 to EM2_2.

The first shift register 41 includes a plurality of cascaded first shift register units G1_1 to G1_N, each of which is connected to one first light emitting control line EM1. As shown in FIG. 8, a first-stage first shift register unit G1_1 is connected to the first light emitting control line EM1 to which pixel circuits in the first row are connected; a second-stage first shift register unit G1_2 is connected to the first light emitting control line EM1 to which pixel circuits in the second row are connected, . . . , and a Nth-stage first shift register unit G1_N is connected to the first light emitting control line EM1 to which pixel circuits in the Nth row are connected. The second shift register 42_1 includes a plurality of cascaded second shift register units G21_1 to G21_N, and the second shift register 42_2 includes a plurality of cascaded second shift register units G22_1 to G22_N. A first-stage second shift register unit G21_1 and a first-stage second shift register unit G22_1 are connected to two second light emitting control lines EM2_1 to EM2_2 to which pixel circuits in the first row are connected, respectively; a second-stage second shift register unit G21_2 and a second-stage second shift register unit G22_2 are connected to two second light emitting control lines EM2_1 to EM2_2 to which pixel circuits in the second row are connected, respectively; . . . , a Nth-stage second shift register unit G21_N and a Nth-stage second shift register unit G22_N are connected to two second light emitting control lines EM2_1 to EM2_2 to which pixel circuits in the Nth row are connected, respectively.

In some embodiments, at least two of the plurality of light emitting devices connected to a same pixel circuit have different colors. The first driving circuit 30 is specifically configured to provide, in the first reset stage of the pixel circuit, a valid level signal to the first reset line to which the pixel circuit is connected; in the data write stage of the pixel circuit, provide a valid level signal to the scan line to which the pixel circuit is connected; and in the second reset stage of the pixel circuit, provide a valid level signal to each second reset line to which the pixel circuit is connected to cause the corresponding second reset sub-circuit to write the voltage on the initialization signal line to the first electrode of the light emitting device. The second driving circuit 40 is specifically configured to provide a valid level signal to the first light emitting control line EM1 to which the pixel circuit is connected and provide a valid level signal to the plurality of second light emitting control lines EM2_1 to EM2_2 to which the pixel circuit is connected, respectively, in the light emitting stage of the pixel circuit.

In this case, the plurality of light emitting devices may be respectively used as a plurality of sub-pixels of the pixel, and since the plurality of light emitting devices in the pixel structure share one pixel circuit, it is advantageous to improve the resolution of the display device.

In other embodiments, the plurality of light emitting devices connected to a same pixel circuit have a same color. The second driving circuit 40 is specifically configured to provide a valid level signal to the first light emitting control line EM1 to which the pixel circuit is connected, in the light emitting stage of each display period of the pixel circuit; and provide a valid level signal to the n second light emitting control lines to which the pixel circuit is connected by turns in light emitting stages in n consecutive display periods, wherein n is the number of light emitting devices in the pixel structure.

For example, if a control circuit of the display device determines that the pictures in a certain region of the display substrate remain unchanged when continuously displaying multiple frames of pictures, the control circuit may send a control signal to the second driving circuit 40, such that the second driving circuit 40 controls the plurality of light emitting devices in each pixel structure in the region to emit light by turns in a plurality of continuous display periods according to the control signal, so as to improve the display burn-in problem.

In other embodiments, the plurality of light emitting devices connected to a same pixel circuit have a same color. One of the second light emitting control lines EM2_1 to EM2_2 to which the pixel structure is connected is the primary light emitting control line, and the remaining second light emitting control lines are alternative light emitting control lines. The second driving circuit 40 is specifically configured to provide a valid level signal to the first light emitting control line EM1, the primary light emitting control line to which the pixel circuit is connected, in the light emitting stages of the first m display periods of the pixel circuit; provide a valid level signal to the first light emitting control line EM1, the primary light emitting control line, and the at least one alternative light emitting control line to which the pixel circuit is connected, in light emitting stages of display periods after the m-th display period; wherein m is determined according to luminance decay curves of the plurality of light emitting devices to which the pixel circuit is connected.

That is, before the accumulated display duration of the display device reaches the predetermined duration, one light emitting device in the pixel structure is controlled to emit light in each display period. After the accumulated display duration of the display device reaches the predetermined duration, at least two light emitting devices in the pixel structure are controlled to emit light in each display period, so that the problem of luminance reduction of the pixel structure caused by the light emitting devices emitting light for a longer time may be compensated, and the service life of the display device is prolonged.

The specific driving process for the pixel structure has been described above and will not be described herein.

It should be understood that the above embodiments are merely exemplary embodiments adopted to explain the principle of the present disclosure, and the present disclosure is not limited thereto. It will be apparent to a person skilled in the art that various changes and modifications may be made therein without departing from the spirit and scope of the present disclosure, and such changes and modifications also fall within the scope of the present disclosure.

What is claimed is:

1. A driving method for a pixel structure, the pixel structure comprising: a pixel circuit and a plurality of light emitting devices; wherein the pixel circuit comprises: a driving transistor, a storage capacitor, a write compensation sub-circuit, a first reset sub-circuit, a first light emitting control sub-circuit, a plurality of second light emitting control sub-circuits, and a plurality of second reset sub-circuits, wherein two terminals of the storage capacitor are respectively connected to a gate of the driving transistor and a first power line; the second light emitting control sub-circuits and the second reset sub-circuits are connected to the light emitting devices in a one-to-one correspondence; the plurality of second reset sub-circuits are respectively connected to a plurality of second reset lines; the plurality of second light emitting control sub-circuits are connected to a plurality of second light emitting control lines, respectively;

the pixel circuit has a plurality of display periods, each display period comprises: a first reset stage, a data write stage, a second reset stage and a light emitting stage, the driving method comprises steps of:

in the first reset stage, providing a valid level signal to a first reset line to cause the first reset sub-circuit to write a voltage signal on an initialization signal line into the gate of the driving transistor;

in the data write stage, providing a valid level signal to a scan line to cause the write compensation sub-circuit to write a voltage signal on a data line into the first electrode of the driving transistor and cause the gate and the second electrode of the driving transistor to be directly electrically connected to each other;

in the second reset stage, providing a valid level signal to at least one second reset line to cause the corresponding second reset sub-circuit to write a voltage on the initialization signal line into a first electrode of the light emitting device; and in the light emitting stage, providing a valid level signal to a first light emitting control line and providing a valid level signal to at least one second light emitting control line, so that the first light emitting control sub-circuit causes the first power line to be directly electrically connected to the first electrode of the driving transistor each other, and the at least one second light emitting control sub-circuit causes the second electrode of the driving transistor and the corresponding light emitting device to be directly electrically connected to each other, wherein at least two of the plurality of light emitting devices connected to a same pixel circuit have different colors;

the step of providing a valid level signal to the at least one second reset line comprises: providing a valid level signal to each second reset line; and the step of providing a valid level signal to the at least one second light emitting control line comprises: providing a valid level signal to the plurality of second light emitting control lines, respectively.

2. The driving method according to claim 1, wherein the first reset sub-circuit comprises: a first reset transistor, a gate of the first reset transistor is connected to a first reset line, a first electrode of the first reset transistor is connected to the gate of the driving transistor, and a second electrode of the first reset transistor is connected to the initialization signal line;

in the first reset stage, providing a valid level signal to a first reset line to cause the first reset sub-circuit to write a voltage signal on an initialization signal line into the gate of the driving transistor, comprises:

in the first reset stage, providing a valid level signal to the first reset line to cause the first electrode and the second electrode of the first reset line to be directly electrically connected to each other.

3. The driving method according to claim 1, wherein each of the plurality of second reset sub-circuits comprises: a second reset transistor; a gate of the second reset transistor is connected to the second reset line; a first electrode of the second reset transistor is connected to the light emitting device; and a second electrode of the second reset transistor is connected to the initialization signal line;

in the second reset stage, providing a valid level signal to at least one second reset line to cause the corresponding second reset sub-circuit to write the voltage on the initialization signal line into the first electrode of the light emitting device, comprises:

in the second reset stage, providing a valid level signal to at least one second reset line to cause the first electrode and the second electrode of the corresponding second reset transistor to be directly electrically connected to each other.

4. The driving method according to claim 1, wherein the first light emitting control sub-circuit comprises: a first light emitting control transistor, a gate of the first light emitting control transistor is connected to the first light emitting control line, a first electrode of the first light emitting control transistor is connected to the first power line, and a second electrode of the first light emitting control transistor is connected to the first electrode of the driving transistor; each of the second light emitting control sub-circuits comprises: a second light emitting control transistor; a gate of the second light emitting control transistor is connected to the second light emitting control line; a first electrode of the second light emitting control transistor is connected to the second electrode of the driving transistor; and a second electrode of the second light emitting control transistor is connected to the light emitting device, in the light emitting stage, providing a valid level signal to a first light emitting control line and providing a valid level signal to at least one second light emitting control line, so that the first light emitting control sub-circuit causes the first power line and the first electrode of the driving transistor to be directly electrically connected to each other, and the at least one second light emitting control sub-circuit causes the second electrode of the driving transistor and the corresponding light emitting device to be directly electrically connected to each other, comprises:

in the light emitting stage, providing a valid level signal to the first light emitting control line and providing a valid level signal to at least one second light emitting control line, to cause the first electrode and the second electrode of the first light emitting control transistor to be directly electrically connected to each other, and to cause the first electrode and the second electrode of at least one second light emitting control transistor to be directly electrically connected to each other.

5. A driving method for a pixel structure, the pixel structure comprising: a pixel circuit and a plurality of light emitting devices; wherein the pixel circuit comprises: a driving transistor, a storage capacitor, a write compensation sub-circuit, a first reset sub-circuit, a first light emitting control sub-circuit, a plurality of second light emitting control sub-circuits, and a plurality of second reset sub-circuits, wherein two terminals of the storage capacitor are respectively connected to a gate of the driving transistor and a first power line; the second light emitting control sub-circuits and the second reset sub-circuits are connected to the light emitting devices in a one-to-one correspondence; the plurality of second reset sub-circuits are respectively connected to a plurality of second reset lines; the plurality of second light emitting control sub-circuits are connected to a plurality of second light emitting control lines, respectively;

the pixel circuit has a plurality of display periods, each display period comprises: a first reset stage, a data write stage, a second reset stage and a light emitting stage, the driving method comprises steps of:

in the first reset stage, providing a valid level signal to a first reset line to cause the first reset sub-circuit to write a voltage signal on an initialization signal line into the gate of the driving transistor;

in the data write stage, providing a valid level signal to a scan line to cause the write compensation sub-circuit to write a voltage signal on a data line into the first electrode of the driving transistor and cause the gate and the second electrode of the driving transistor to be directly electrically connected to each other;

in the second reset stage, providing a valid level signal to at least one second reset line to cause the corresponding second reset sub-circuit to write a voltage on the initialization signal line into a first electrode of the light emitting device; and in the light emitting stage, providing a valid level signal to a first light emitting control line and providing a valid level signal to at least one second light emitting control line, so that the first light emitting control sub-circuit causes the first power line to be directly electrically connected to the first electrode of the driving transistor each other, and the at least one second light emitting control sub-circuit causes the second electrode of the driving transistor and the corresponding light emitting device to be directly electrically connected to each other, wherein the plurality of light emitting devices connected to a same pixel circuit have a same color; one of the second light emitting control lines to which the pixel structure is connected is used as a primary light emitting control line, and the remaining second light emitting control lines are used as alternative light emitting control lines; and a valid level signal is provided to the first light emitting control line and the primary light emitting control line in the light emitting stages of the first m display periods; a valid level signal is provided to the first light emitting control line, the primary light emitting control line and at least one of the alternative light emitting control lines, in the light emitting stages of display periods following the m-th display period; wherein m is determined according to a luminance decay curves of the light emitting devices.

6. The driving method according to claim 5, wherein the first reset sub-circuit comprises: a first reset transistor, a gate of the first reset transistor is connected to a first reset line, a first electrode of the first reset transistor is connected to the gate of the driving transistor, and a second electrode of the first reset transistor is connected to the initialization signal line;

in the first reset stage, providing a valid level signal to a first reset line to cause the first reset sub-circuit to write a voltage signal on an initialization signal line into the gate of the driving transistor, comprises:

in the first reset stage, providing a valid level signal to the first reset line to cause the first electrode and the second electrode of the first reset line to be directly electrically connected to each other.

7. The driving method according to claim 6, wherein each of the plurality of second reset sub-circuits comprises: a second reset transistor; a gate of the second reset transistor is connected to the second reset line; a first electrode of the second reset transistor is connected to the light emitting device; and a second electrode of the second reset transistor is connected to the initialization signal line;

in the second reset stage, providing a valid level signal to at least one second reset line to cause the corresponding second reset sub-circuit to write the voltage on the initialization signal line into the first electrode of the light emitting device, comprises:

in the second reset stage, providing a valid level signal to at least one second reset line to cause the first electrode and the second electrode of the corresponding second reset transistor to be directly electrically connected to each other.

8. The driving method according to claim 7, wherein the first light emitting control sub-circuit comprises: a first light emitting control transistor, a gate of the first light emitting control transistor is connected to the first light emitting control line, a first electrode of the first light emitting control transistor is connected to the first power line, and a second electrode of the first light emitting control transistor is connected to the first electrode of the driving transistor; each of the second light emitting control sub-circuits comprises: a second light emitting control transistor; a gate of the second light emitting control transistor is connected to the second light emitting control line; a first electrode of the second light emitting control transistor is connected to the second electrode of the driving transistor; and a second electrode of the second light emitting control transistor is connected to the light emitting device, in the light emitting stage, providing a valid level signal to a first light emitting control line and providing a valid level signal to at least one second light emitting control line, so that the first light emitting control sub-circuit causes the first power line and the first electrode of the driving transistor to be directly electrically connected to each other, and the at least one second light emitting control sub-circuit causes the second electrode of the driving transistor and the corresponding light emitting device to be directly electrically connected to each other, comprises:

in the light emitting stage, providing a valid level signal to the first light emitting control line and providing a valid level signal to at least one second light emitting control line, to cause the first electrode and the second electrode of the first light emitting control transistor to be directly electrically connected to each other, and to cause the first electrode and the second electrode of at least one second light emitting control transistor to be directly electrically connected to each other.

9. A pixel structure, comprising: a pixel circuit and a plurality of light emitting devices; wherein the pixel circuit comprises: a driving transistor, a storage capacitor, a write compensation sub-circuit, a first reset sub-circuit, a first light emitting control sub-circuit, a plurality of second light emitting control sub-circuits, and a plurality of second reset sub-circuits, wherein two terminals of the storage capacitor are respectively connected to a gate of the driving transistor and a first power line; the second light emitting control sub-circuits and the second reset sub-circuits are connected to the light emitting devices in a one-to-one correspondence;

the write compensation sub-circuit is configured to write a voltage signal on a data line into a first electrode of the driving transistor and cause the gate and a second electrode of the driving transistor to be directly electrically connected to each other in response to a signal from a scan line;

the first reset sub-circuit is configured to write a voltage signal on an initialization signal line to the gate of the driving transistor in response to a signal from a first reset line;

the second reset sub-circuit is configured to write the voltage signal on the initialization signal line to a first electrode of the light emitting device to which the second reset sub-circuit is connected, in response to a signal from the corresponding second reset line;

the first light emitting control sub-circuit is configured to cause the first power line and the first electrode of the driving transistor to be directly electrically connected to each other in response to a signal from a first light emitting control line; and the second light emitting control sub-circuit is configured to cause the second electrode of the driving transistor and the light emitting device to which the second light emitting control sub-circuit is connected to be directly electrically connected to each other, in response to a signal from the corresponding second light emitting control line, wherein the plurality of light emitting devices connected to a same pixel circuit have a same color; one of the second light emitting control lines to which the pixel structure is connected is used as a primary light emitting control line, and the remaining second light emitting control lines are used as alternative light emitting control lines; and a valid level signal is provided to the first light emitting control line and the primary light emitting control line in the light emitting stages of the first m display periods; a valid level signal is provided to the first light emitting control line, the primary light emitting control line and at least one of the alternative light emitting control lines, in the light emitting stages of display periods following the m-th display period; wherein m is determined according to a luminance decay curves of the light emitting devices.

10. The pixel structure according to claim 9, wherein each of the plurality of second reset sub-circuit comprises: a second reset transistor; a gate of the second reset transistor is connected to the second reset line; a first electrode of the second reset transistor is connected to the light emitting device; and a second electrode of the second reset transistor is connected to the initialization signal line;

the second light emitting control sub-circuit comprises: a second light emitting control transistor, a gate of which is connected to the second light emitting control line, a first electrode of which is connected to the second electrode of the driving transistor, and a second electrode of which is connected to the light emitting device.

11. The pixel structure according to claim 9, wherein the number of the light emitting devices in the pixel structure is two, a width-to-length ratio of the driving transistor is between 1/8 and 1/12; or the number of the light emitting devices in the pixel structure is three, and the width-to-length ratio of the driving transistor is between 1/3 and 1/5.

12. A display device comprising a display substrate, a first driving circuit and a second driving circuit, wherein the display substrate comprises a plurality of pixels, at least one of which has the pixel structure of claim 9;

the first driving circuit is configured to: in the first reset stage of the pixel circuit, provide a valid level signal to the first reset line to which the pixel circuit is connected to cause the first reset sub-circuit to write the voltage signal on the initialization signal line into the gate of the driving transistor; in the data write stage of the pixel circuit, provide a valid level signal to the scan line to which the pixel circuit is connected to cause the data write sub-circuit to write the voltage signal on the data line into the first electrode of the driving transistor; and in the second reset stage of the pixel circuit, provide a valid level signal to at least one second reset line to which the pixel circuit is connected to cause the corresponding second reset sub-circuit to write the voltage on the initialization signal line into the first electrode of the light emitting device;

the second driving circuit is configured to: in the light emitting stage of the pixel circuit, provide a valid level signal to the first light emitting control line to which the pixel circuit is connected, and provide a valid level signal to at least one second light emitting control line to which the pixel circuit is connected, so that the first light emitting control sub-circuit causes the first power line and the first electrode of the driving transistor to be directly electrically connected to each other, and at least one second light emitting control sub-circuit causes the second electrode of the driving transistor and the corresponding light emitting device to be directly electrically connected to each other.

* * * * *